US009744086B2

(12) United States Patent
Watanabe et al.

(10) Patent No.: US 9,744,086 B2
(45) Date of Patent: Aug. 29, 2017

(54) ROLLING TRANSPORT COTS

(71) Applicant: Ferno-Washington, Inc., Wilmington, OH (US)

(72) Inventors: Akira Watanabe, Sayama (JP); Pavol Graf, Ruzomberok (SK); Michal Vacula, Zvolen (SK)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 15/071,396

(22) Filed: Mar. 16, 2016

(65) Prior Publication Data

US 2016/0193092 A1 Jul. 7, 2016

Related U.S. Application Data

(63) Continuation of application No. 14/312,964, filed on Jun. 24, 2014, now Pat. No. 9,314,384.

(60) Provisional application No. 61/840,536, filed on Jun. 28, 2013.

(51) Int. Cl.
*A61G 1/02* (2006.01)
*A61G 1/056* (2006.01)

(52) U.S. Cl.
CPC ..... *A61G 1/0237* (2013.01); *A61G 1/0212* (2013.01); *A61G 1/0262* (2013.01); *A61G 1/0287* (2013.01); *A61G 1/0293* (2013.01); *A61G 1/056* (2013.01)

(58) Field of Classification Search
CPC .. A61G 1/0237; A61G 1/0212; A61G 1/0262; A61G 1/0287; A61G 1/0293; A61G 1/056
See application file for complete search history.

(56) References Cited

U.S. PATENT DOCUMENTS

| | | | |
|---|---|---|---|
| 5,015,024 | A | 5/1991 | Bloemer |
| 6,203,085 | B1 | 3/2001 | Ferris |
| 6,735,794 | B1 | 5/2004 | Way et al. |
| 7,856,685 | B2 | 12/2010 | Matunaga et al. |
| 8,381,330 | B2 | 2/2013 | Roussy et al. |
| 2008/0001421 | A1 | 1/2008 | Matunaga et al. |
| 2008/0224430 | A1 | 9/2008 | Vegt |
| 2009/0039666 | A1 | 2/2009 | Lambarth |
| 2009/0178200 | A1 | 7/2009 | Lambarth et al. |
| 2011/0266821 | A1 | 11/2011 | Goto et al. |

*Primary Examiner* — Lori L Lyjak
(74) *Attorney, Agent, or Firm* — Dinsmore & Shohl LLP

(57) ABSTRACT

In one embodiment, a rolling transport cot may include an elongate frame, one or more support linkages, an arcuate coupling member, and a swivel caster. The one or more support linkages may include a pivoting link that is in rotatable engagement with the elongate frame, a traveling link that is in sliding and rotatable engagement with the elongate frame, and an equalizing link that is in rotatable engagement with the traveling link. The arcuate coupling member can be in rotatable engagement with the pivoting link and the equalizing link. The swivel caster may include a wheel that rotates along a surface and a swivel mechanism that can rotate around an axis that is aligned with the surface at a swivel angle ϕ. When the traveling link is urged along the elongate frame, the swivel angle ϕ of the swivel mechanism can be substantially constant.

19 Claims, 14 Drawing Sheets

ROLLING TRANSPORT COTS

CROSS-REFERENCE TO RELATED APPLICATIONS

This application is filed as a continuation of U.S. application Ser. No. 14/312,964 filed on Jun. 24, 2014, which claims the benefit of U.S. Provisional Application No. 61/840,536 filed Jun. 28, 2013.

BACKGROUND

The present specification generally relates to transport cots, such as of the type used to transport patients. In particular, the present specification relates to rolling transport cots adapted to facilitate the treatment of patients.

Rolling transport cots can include an undercarriage that is configured to support a stretcher. The stretcher can be used to support a patient when the rolling transport cot is being guided by one or more operators at a foot end, or when the rolling transport is held at a substantially fixed location by one or more operators.

Rolling transport cots can be configured to be able to be rolled into various types of rescue vehicles, such as ambulances, vans, station wagons, modular type rescue vehicles, aircrafts, helicopters and the like. Accordingly, the undercarriage of the rolling transport cot can be configured to articulate to various heights in order to support the stretcher. For example, the stretcher can be provided at a height sufficient to clear a platform of an emergency vehicle to facilitate loading of the patient upon the emergency vehicle. Thus, the rolling transport cot can include linkages configured to extend for raising the stretcher and collapse the undercarriage beneath the stretcher.

During the loading of a patient onto a platform in an emergency vehicle, the undercarriage linkages may be collapsed. As the undercarriage linkages collapse, an operator can support the weight of the patient and the rolling transport cot and push the rolling transport cot onto the platform. In order to facilitate the loading of a patient onto such a platform, the undercarriage can include loading rollers at its head end that are positioned at substantially the same height of the platform such that the loading wheels engage the platform prior to the collapse of the undercarriage. Thus the leading end of the rolling transport cot can be supported on the platform and the operator can support the foot end of the rolling transport cot. Once the head end of the rolling transport cot is supported on the platform, the operator can actuate one or more mechanisms (e.g., a handle) to cause part or the entire undercarriage of the rolling transport cot to collapse and load the rolling transport cot upon the emergency vehicle.

While many patients can wait to receive treatment after being transported by the emergency vehicle, some patients may require medical treatment prior to being transported. For example, in some circumstances, a patient may need to receive treatment prior to being loaded into the emergency vehicle. Thus, patients may be treated while being supported by the rolling transport cot.

Accordingly, a need exists for alternative rolling transport cots adapted to facilitate the treatment of patients.

SUMMARY

In one embodiment, a rolling transport cot may include an elongate frame, one or more support linkages, an arcuate coupling member, and a swivel caster. The one or more support linkages may include a pivoting link that is in rotatable engagement with the elongate frame, a traveling link that is in sliding and rotatable engagement with the elongate frame, and an equalizing link that is in rotatable engagement with the traveling link. The arcuate coupling member can be in rotatable engagement with the pivoting link and the equalizing link. The swivel caster may include a wheel that rotates along a surface and a swivel mechanism in rotatable engagement with the arcuate coupling member. The swivel mechanism can rotate around an axis that is aligned with the surface at a swivel angle $\phi$. When the traveling link is urged along the elongate frame, a vertical distance between the elongate frame and the swivel caster can be altered. When the traveling link is urged along the elongate frame, the arcuate coupling member can rotate with respect to the pivoting link and the equalizing link. When the traveling link is urged along the elongate frame, the swivel angle $\phi$ of the swivel mechanism can be substantially constant.

In another embodiment, a rolling transport cot may include an elongate frame, one or more support linkages, and a modular support member. The elongate frame can be supported by the one or more support linkages. A height of the elongate frame can be altered by transitioning the one or more support linkages between an extended state and a cardiopulmonary resuscitation (CPR) state. The one or more support linkages may include a cross member disposed between two links of the one or more support linkages. The modular support member may include a rigid support member coupled to the elongate frame, and an articulating support member coupled to the cross member. The rigid support member and the articulating support member can be aligned. When the one or more support linkages is in the extended state, the rigid support member and the articulating support member can be separated. When the one or more support linkages is in the CPR state, the rigid support member and the articulating support member can be united.

In another embodiment, a rolling transport cot may include an elongate frame, one or more support linkages, an arcuate coupling member, a swivel caster, and a brake mechanism. The elongate frame can be supported by the one or more support linkages. A height of the elongate frame can be altered by transitioning the one or more support linkages between an extended state and a collapsed state. The arcuate coupling member can be in rotatable engagement with the one or more support linkages. The swivel caster may include a wheel that rotates along a surface and a swivel mechanism in rotatable engagement with the arcuate coupling member. The brake mechanism may include a rotating cam, an angular lever, and a translating cam. The rotating cam can be in rotatable engagement with the arcuate coupling member. The angular lever can be in rotatable engagement with the arcuate coupling member. The translating cam can be coupled to the elongate frame and aligned with the angular lever. When the one or more support linkages are in the collapsed state, the translating cam can rotate the angular lever to actuate the brake mechanism such that the brake mechanism resists rotation of the wheel.

In yet another embodiment, a rolling transport cot may include an elongate frame, one or more support linkages, and a removable stretcher. The elongate frame can be supported by the one or more support linkages. A height of the elongate frame can be altered by transitioning the one or more support linkages between an extended state and a collapsed state. The removable stretcher can be in releasable engagement with the elongate frame in an ordered state or a reversed state. The removable stretcher can include a head end indication member and a foot end indication member. The elongate frame can include a head end ordered indicator, a foot end reversed indicator, a head end reversed indicator and a foot end ordered indicator. When the removable stretcher is in the ordered state, the head end indication member can be aligned with the head end ordered indicator and the foot end indication member can be aligned with the foot end ordered indicator. When the removable stretcher is in the reversed state, the head end indication member can be aligned with the head end reversed indicator and the foot end indication member can be aligned with the foot end reversed indicator.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
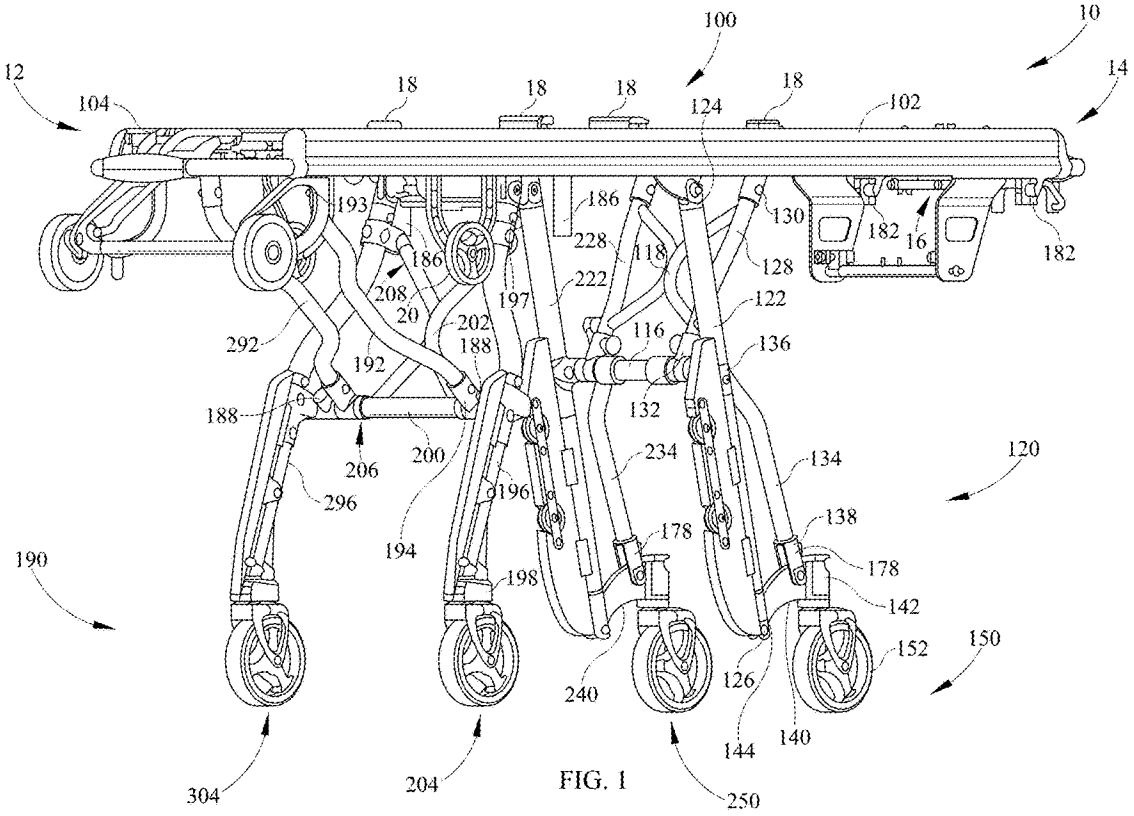
FIG. 1 schematically depicts a rolling transport cot according to one or more embodiments shown and described herein.

FIG. 1 generally depicts one embodiment of a rolling transport cot. The rolling transport cot generally includes an elongate frame and one or more support linkages for altering the height of the elongate frame. Various embodiments of the rolling transport cot and the operation of the rolling transport cot will be described in more detail herein.

The phrase "head end" may be used interchangeably with the phrase "front end," and the phrase "foot end" may be used interchangeably with the phrase "back end." Furthermore, it is noted that the embodiments of the present disclosure can include embodiments where the "head end" and "foot end" are reversed. Thus, while the phrases are used consistently throughout for clarity, the embodiments described herein may be reversed without departing from the scope of the present disclosure. Additionally, it is noted that the term "patient" generally refers to any living thing or formerly living thing such as, for example, a human, an animal, a corpse or the like.

Referring now to FIG. 1, a rolling transport cot 10 according to the embodiments described herein is schematically depicted. The rolling transport cot 10 can be described as having a head end 12 and a foot end 14. For example, the rolling transport cot 10 can include a removable stretcher 30 (FIGS. 7A-8B) that can be releasably coupled to the rolling transport cot 10 via one or more coupling members 18. In some embodiments, patients can be loaded onto a platform of an emergency vehicle with their head located near the head end 12 of the rolling transport cot 10. Accordingly, the feet of the patient can be located near the foot end 14 of the rolling transport cot 10. However, while the head end 12 and foot end 14 serve as a useful notation, the patient need not be transported in such a manner.

The rolling transport cot 10 can comprise an elongate frame 100 for providing a structural support and mounting locations for a rear support linkage 120 and a front support linkage 190. Accordingly, the elongate frame can include a plurality of structural members combined to provide a rigid body suitable to transport patients while resisting loads such as, for example, torsional, bending, and the like. The elongate frame 100 can be made from materials having relatively high strength such as, for example, aluminum, steel, hard plastics, composites, and the like.

The elongate frame 100 can extend from the head end 12 to the foot end 14 of the rolling transport cot 10. In some embodiments, the elongate frame 100 can comprise a first lateral support member 102 and a second lateral support member 104 that run laterally along the length of the elongate frame 100. The first lateral support member 102 and the second lateral support member 104 can be rigidly coupled to one another to form a substantially rigid shape. For example, the first lateral support member 102 and the second lateral support member 104 can be coupled at both the head end 12 and the foot end of the rolling transport cot 10 to form a substantially rectangular arrangement. It is noted that, while the elongate frame 100 is depicted as being substantially rectangular, other shapes are contemplated. In some embodiments, the first lateral support member 102, the second lateral support member 104, or both can be provided with a channel configured to constrain a rolling mechanism in a sliding arrangement.

The rolling transport cot 10 can comprise a rear support linkage 120 that cooperates with the elongate frame 100 to change the height or alter an angle of inclination of the elongate frame 100. The rear support linkage 120 can comprise a plurality of links that are joined to one another in rotating, sliding, or both rotating and sliding engagement. Each of the links can be formed from substantially rigid materials such as, for example, aluminum, steel, hard plastics, composites, and the like. Additionally, it is noted that while the links are depicted as being formed from round tubing, the links can be formed from other types of tubing (e.g., square), plate materials, or any other material suitable to support patients in transport.

The rear support linkage 120 can comprise a pivoting link 122 that extends between a frame end 124 and a wheel end 126. The frame end 124 of the pivoting link 122 can be in rotatable engagement with the elongate frame 100. For example, the frame end 124 of the pivoting link 122 can be pinned to the first lateral support member 102 of the elongate frame. Accordingly, the frame end 124 of the pivoting link 122 can be configured for rotation without substantial movement laterally between the head end 12 and the foot end 14. In some embodiments, the pivoting link 122 can be in rotatable engagement with the elongate frame 100 at or near its center. In some embodiments, the rotating engagement can be between about 45% to about 60% of the span of the elongate frame 100.

The rear support linkage 120 can further comprise a traveling link 128 that extends between a frame end 130 and a lower end 132. The frame end 130 of the traveling link 128 can be in rotatable engagement and sliding engagement with the elongate frame 100. In some embodiments, the frame end 130 of the traveling link 128 can be in rotatable engagement and sliding engagement with the first lateral support member 102 of the elongate frame. Accordingly, the frame end 130 of the traveling link 128 can slide between lateral constraints while the traveling link 128 pivots with respect to the elongate frame 100. In some embodiments, the lateral motion of the frame end 130 of the traveling link 128 can be constrained between points substantially near the center of the elongate frame 100 and substantially near the foot end 14 of the elongate frame 100.

Referring still to FIG. 1, the lower end 132 of the traveling link 128 can be in rotating engagement with the pivoting link 122. In some embodiments, the lower end 132 of the traveling link 128 can be in rotating engagement with the pivoting link 122 substantially near the midpoint of the span between the frame end 124 and the wheel end 126 of the pivoting link 122. For example, in some embodiments, the rotating engagement can be between about 45% to about 60% of the span. In some embodiments, the rotating engagement can be formed at a cross member 116 that is rigidly engaged with the pivoting link 122. Accordingly, each of the lower ends 132 of the traveling link 128 and the pivoting link 122 can rotate with respect to one another.

The rear support linkage 120 can further comprise an equalizing link 134 that extends between an upper end 136 and a wheel end 138. The upper end 136 of the equalizing link 134 can be in rotatable engagement with the traveling link 128. In some embodiments, the upper end 136 of the equalizing link 134 can be in rotatable engagement at or near the lower end 132 of the traveling link 128. Accordingly, the upper end 136 of the equalizing link 134 can rotate with respect to the traveling link 128.

According to the embodiments described herein, the rolling transport cot 10 can comprise an arcuate coupling member 140 for linking the rear support linkage 120 to a swivel caster 150. The arcuate coupling member 140 can be a substantially rigid structural member, and thus, can be formed of materials similar to those described above with respect to the elongate frame 100. The arcuate coupling member 140 can extend between a wheel end 142 and an inner end 144. The arcuate coupling member 140 can be formed as a substantially arch shaped member. For example, the arcuate coupling member 140 can form gradually sloping upper and lower surfaces between the inner end 144 and the wheel end 142. In some embodiments, the thickness of the arcuate coupling member 140 between the upper and lower surfaces can increase between the inner end 144 and the wheel end 142, i.e., the inner end 144 of the arcuate coupling member 140 can be thinner than the wheel end 142 of the arcuate coupling member 140.

The arcuate coupling member 140 can be in rotatable engagement with the wheel end 126 of the pivoting link 122 and the wheel end 138 of the equalizing link 134. In some embodiments, the rotatable engagement between the arcuate coupling member 140 and the wheel end 126 of the pivoting link 122 can be offset from the rotatable engagement between the arcuate coupling member 140 and the wheel end 138 of the equalizing link 134. For example, the rotatable engagement between the arcuate coupling member 140 and the wheel end 126 of the pivoting link 122 can be located at or near the inner end 144 of the arcuate coupling member 140. The rotatable engagement between the arcuate coupling member 140 and the wheel end 138 of the equalizing link 134 can be located at or near the wheel end 142 of the arcuate coupling member 140. Accordingly, the wheel end 126 of the pivoting link 122 and the wheel end 138 of the equalizing link 134 can be offset from one another while the rear support linkage 120 is collapsed or extended.

In some embodiments, the wheel end 126 of the pivoting link 122 can be substantially fork shaped to define a recess. Accordingly, the arcuate coupling member 140 can be at least partially received within the recess of the wheel end 126 of the pivoting link 122. In further embodiments, the wheel end 138 of the equalizing link 134 can be substantially fork shaped to define a recess. Accordingly, the arcuate coupling member 140 can be at least partially received within the recess of the wheel end 138 of the equalizing link 134.

Alternatively or additionally, the rear support linkage 120 can comprise a second pivoting link 222, a second traveling link 228, a second equalizing link 234, a second arcuate coupling member 240, and a second swivel caster 250 that are configured in a manner substantially equivalent to the pivoting link 122, the traveling link 128, the equalizing link 134, the arcuate coupling member 140, and the swivel caster 150 described herein. In some embodiments, the rear support linkage 120 can comprise a cross member 116 rigidly engaged to the pivoting link 122 and the second pivoting link 222. Accordingly, the pivoting link 122 and the second pivoting link 222 can move in concert.

In further embodiments, the rear support linkage 120 can further comprise a traveling support member 118 rigidly engaged with the traveling link 128 and the second traveling link 228. The traveling support member 118 can be configured to resist relative twisting between the traveling link 128 and the second traveling link 228, twisting of the elongate frame 100, or both while the front support linkage is actuated. Accordingly, in some embodiments, the traveling support member 118 can be formed in a substantially "X" shape. It is noted that the traveling support member 118 can be formed in any shape suitable to resist twisting of the elongate frame 100 or relative twisting between the traveling link 128 and the second traveling link 228.

The rolling transport cot 10 can comprise a front support linkage 190 that cooperates with the elongate frame 100 to change the height or alter an angle of inclination of the elongate frame 100. Specifically, the front support linkage 190 can be configured to collapse and extend when a mechanism 16 is actuated. The front support linkage 190 can comprise a pivoting link 192 that extends between a frame end 193 and a lower end 194. The frame end 193 of the pivoting link 192 can be in rotatable engagement with the elongate frame 100. Specifically, the frame end 193 of the pivoting link 192 can be pinned to the first lateral support member 102 of the elongate frame. In some embodiments, the frame end of the pivoting link 192 can be in rotatable engagement with the elongate frame 100 at or near the head end 12 of the rolling transport cot 10.

Referring still to FIG. 1, the front support linkage 190 can further comprise a traveling link 196 that extends between a frame end 197 and a wheel end 198. The frame end 197 of the traveling link 196 can be in rotatable engagement and sliding engagement with the elongate frame 100. For example, the frame end 197 of the traveling link 196 can be configured to slide along the elongate frame 100 between constraints. In some embodiments, the frame end 197 of the traveling link 196 can be configured to slide from a point between the middle of the elongate frame 100 and the head end 12 of the elongate frame 100 towards the foot end 14 of the elongate frame 100. Alternatively or additionally, the frame end 197 of the traveling link 196 can be configured to slide between a point between the middle of the elongate frame 100 and the head end 12 of the elongate frame 100 towards the head end 12 of the elongate frame 100.

The wheel end 198 of the traveling link 196 can be coupled to a wheel 204 that is configured to roll along the ground while the rolling transport cot 10 is urged laterally. The traveling link 196 can be in rotatable engagement with the lower end 194 of the pivoting link 192. In some embodiments, a cross member 200 can be rigidly engaged with the traveling link 196 and the lower end 194 of the pivoting link 192 can be in rotatable engagement with the cross member 200. Alternatively or additionally, the cross member 200 can be rigidly engaged with a second traveling link 296, which can be substantially similar to the traveling link 196. Accordingly, the traveling link 196 and the second traveling link 296 can be configured to operate in concert.

It is noted that the second traveling link 296 can be coupled to a second wheel 304 to provide an additional ground contacting rolling member. In embodiments having the second traveling link 296 and second wheel 304, the front support linkage 190 can have a second pivoting link 292 that operates in a manner substantially similar to the pivoting link 192. Specifically, the second pivoting link 292 can be in rotatable engagement with the cross member 200 and the elongate frame 100.

In further embodiments, the front support linkage 190 can comprise a traveling support member 202 that has a lower end 206 and an upper end 208. The traveling support member 202 can be configured to link the traveling link 196 and the second traveling link 296 and to resist twisting of the elongate frame 100 or relative twisting between the traveling link 196 and the second traveling link 296. For example, the upper end 208 of the traveling support member 202 can be rigidly engaged with the traveling link 196 and the second traveling link 296. The lower end 206 of the traveling support member 202 can be in rotatable engagement with the cross member 200. In some embodiments, the traveling support member 202 can be a substantially "X" shaped member. It is noted that the traveling support member 202 can be formed in any shape suitable to resist the twisting described above.

It should now be understood that the rolling transport cot 10 can be provided with the rear support linkage 120 and the front support linkage 190 that provide rolling members for movement of the rolling transport cot 10 across a surface. For example, the rear support linkage 120 can comprise the swivel caster 150 and the second swivel caster 250 and the front support linkage 190 can be provided with the wheel 204 and the second wheel 304. It is noted that, while a four wheeled arrangement is described herein, the rolling transport cot 10 can be configured to roll across a surface with any number of rotational members.

Figure 2A:
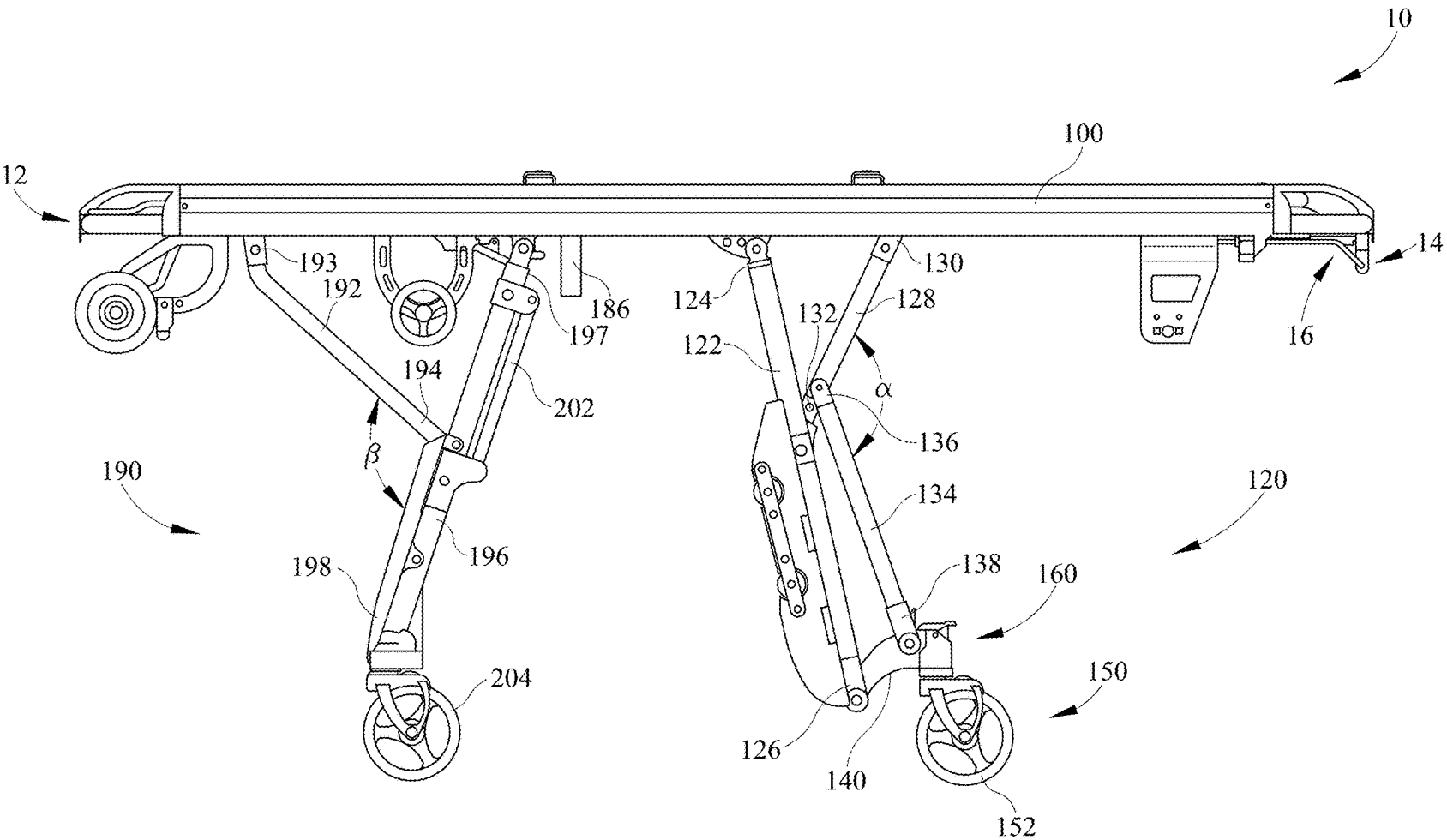
FIGS. 2A-2D schematically depict a rolling transport cot at various heights according to one or more embodiments shown and described herein.
Figure 2B:
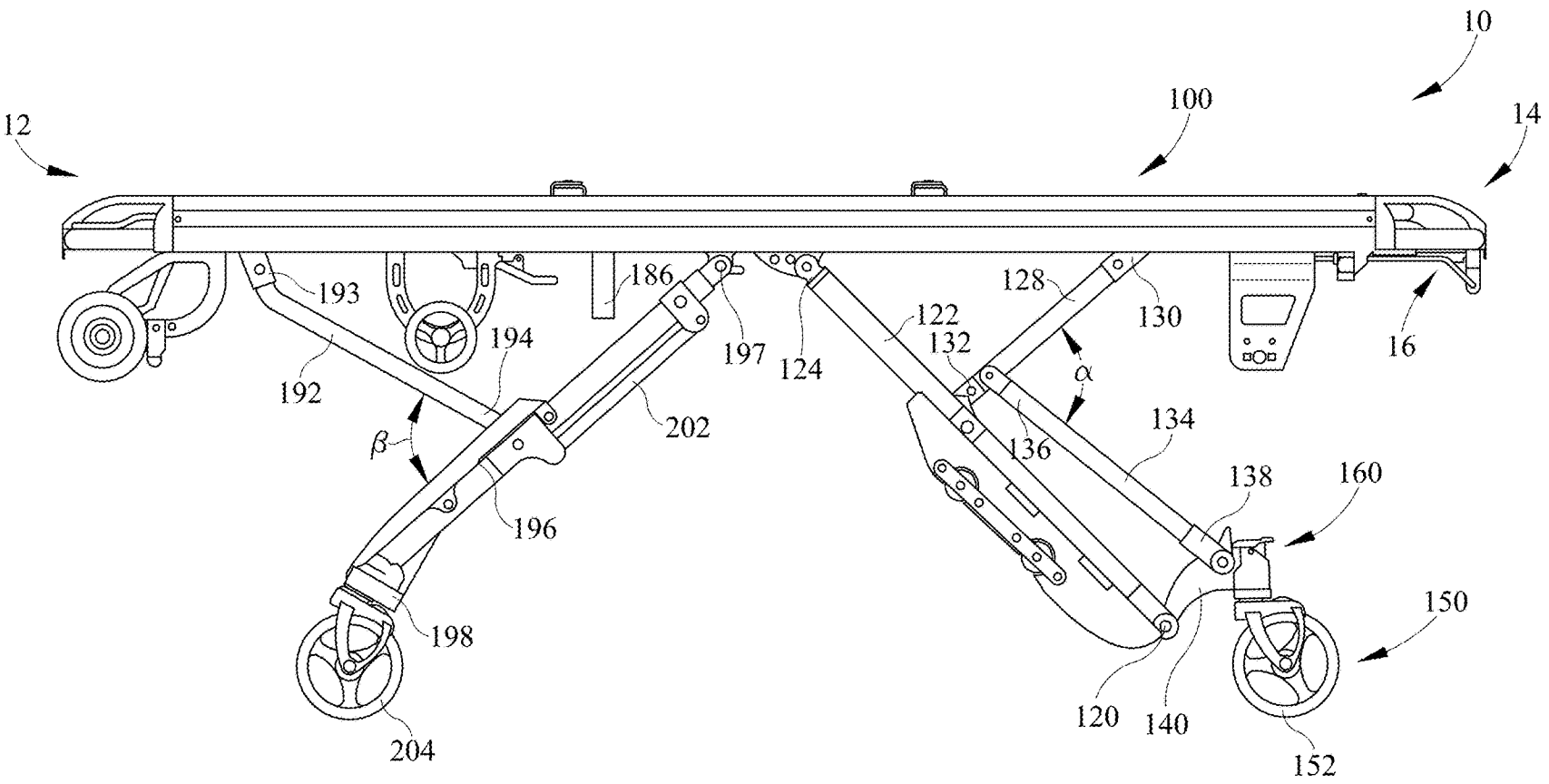
Figure 2C:
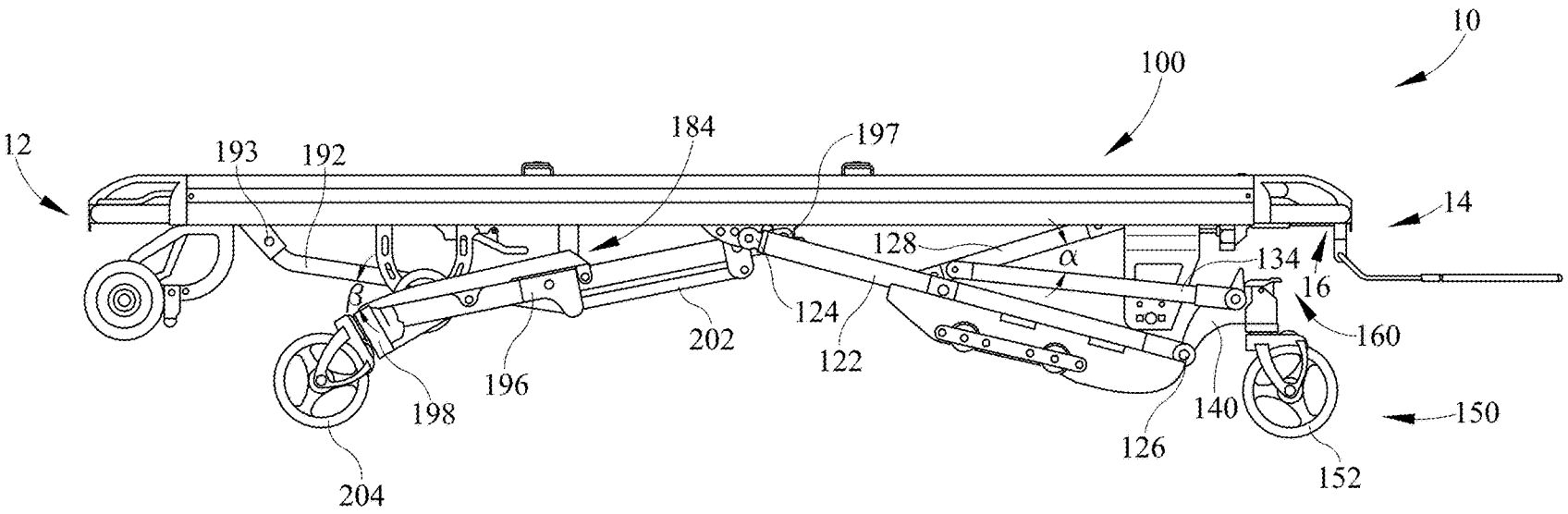
Figure 2D:
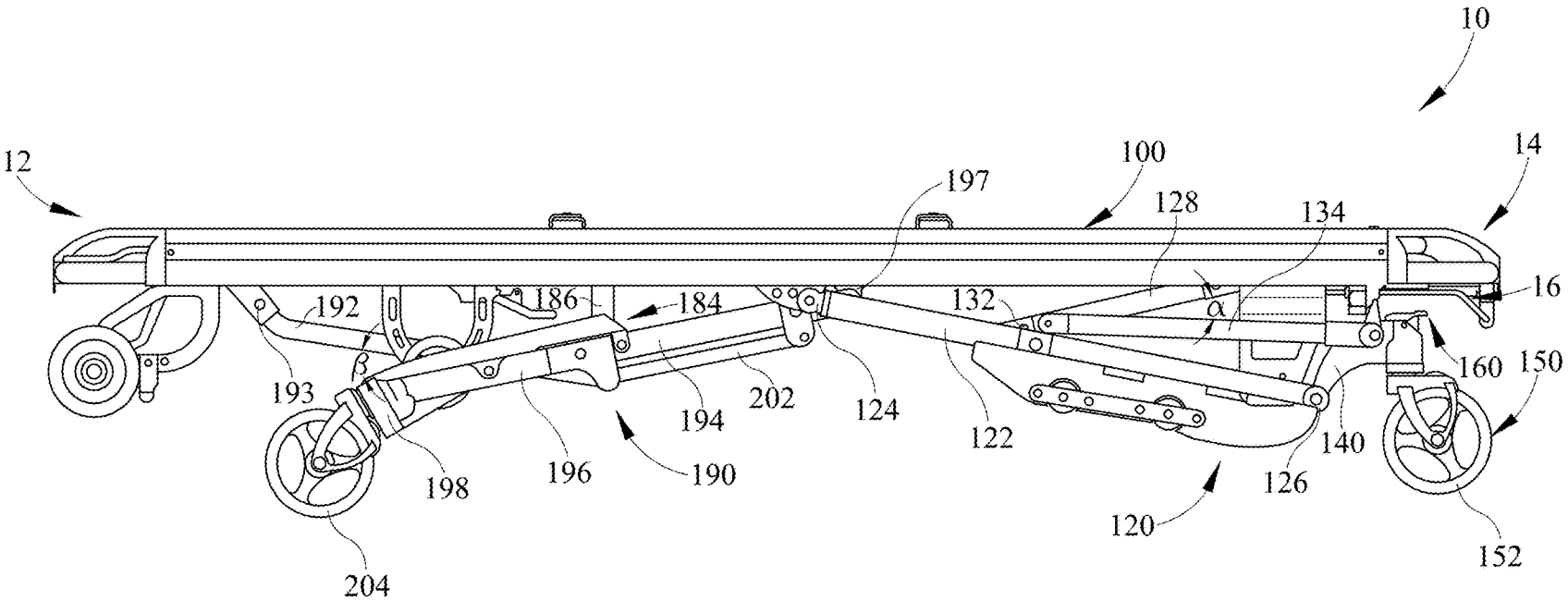

Referring collectively to FIGS. 2A-2D, the rolling transport cot 10 can be configured to roll across surfaces with the rear support linkage 120 and the front support linkage 190 at various states of extension and collapse. In some embodiments, the rolling transport cot 10 can traverse between a fully extended state (FIG. 2A), a mid-level state (FIG. 2B), a cardiopulmonary resuscitation (CPR) state (FIG. 2C), and a fully collapsed state (FIG. 2D). For example, the mechanism 16 can be actuated to allow the rolling transport cot 10 to be urged between the states of extension and collapse. In some embodiments, the rolling transport cot 10 can be keyed to stop (e.g., when the mechanism 16 is released) at various discrete states of extension and collapse, which can include some or all of the fully extended state, the mid-level state, the CPR state, the fully collapsed state, or any state there between.

Referring now to FIG. 2A, the rolling transport cot 10 can be at the fully extended state. Specifically, the distance from the elongate frame 100 and the swivel caster 150 can be at a relative maximum. Additionally, the distance from the elongate frame 100 and the wheel 204 can be at a relative maximum. A rear linkage angle $\alpha$ can be defined by the intersection of the traveling link 128 and the equalizing link 134. Similarly, a front linkage angle $\beta$ can be defined by the intersection of the traveling link 196 and the pivoting link 192. At the fully extended state, each of the rear linkage angle $\alpha$ and the front linkage angle $\beta$ can be obtuse. Accordingly, when on a substantially level surface, the height of the elongate frame can be at a relative maximum.

Referring collectively to FIGS. 2A and 2B, as the rolling transport cot 10 is transitioned from the fully extended state to the mid-level state, the rear support linkage 120 and the front support linkage 190 can be collapsed in concert. Specifically, the frame end 130 of the traveling link 128 can slide towards the foot end 14 of the elongate frame 100. Accordingly, the rear support linkage 120 can rotate and cause the rear linkage angle $\alpha$ to be reduced as the rear support linkage 120 is collapsed. The frame end 197 of the traveling link 196 can also slide towards the foot end 14 of the elongate frame 100. Accordingly, the front support linkage 190 can rotate and cause the front linkage angle $\beta$ to be reduced as the front support linkage 190 is collapsed.

Referring collectively to FIGS. 2B and 2C, the collapsing motion of the rear support linkage 120 and the front support linkage 190 can continue from the mid-level state to the CPR state. Specifically, the frame end 130 of the traveling link 128 can slide further towards the foot end 14 of the elongate frame 100, while the rear linkage angle $\alpha$ is further reduced. The frame end 197 of the traveling link 196 can also slide further towards the foot end 14 of the elongate frame 100, while the front linkage angle $\beta$ is further reduced. In the CPR state, the frame end 197 of the traveling link 196 can be closer to the foot end 14 of the rolling transport cot 10 than the frame end 124 of the pivoting link 122. In some embodiments, when in the CPR state, each of the rear linkage angle $\alpha$ and the front linkage angle $\beta$ can be acute.

Figure 3A:
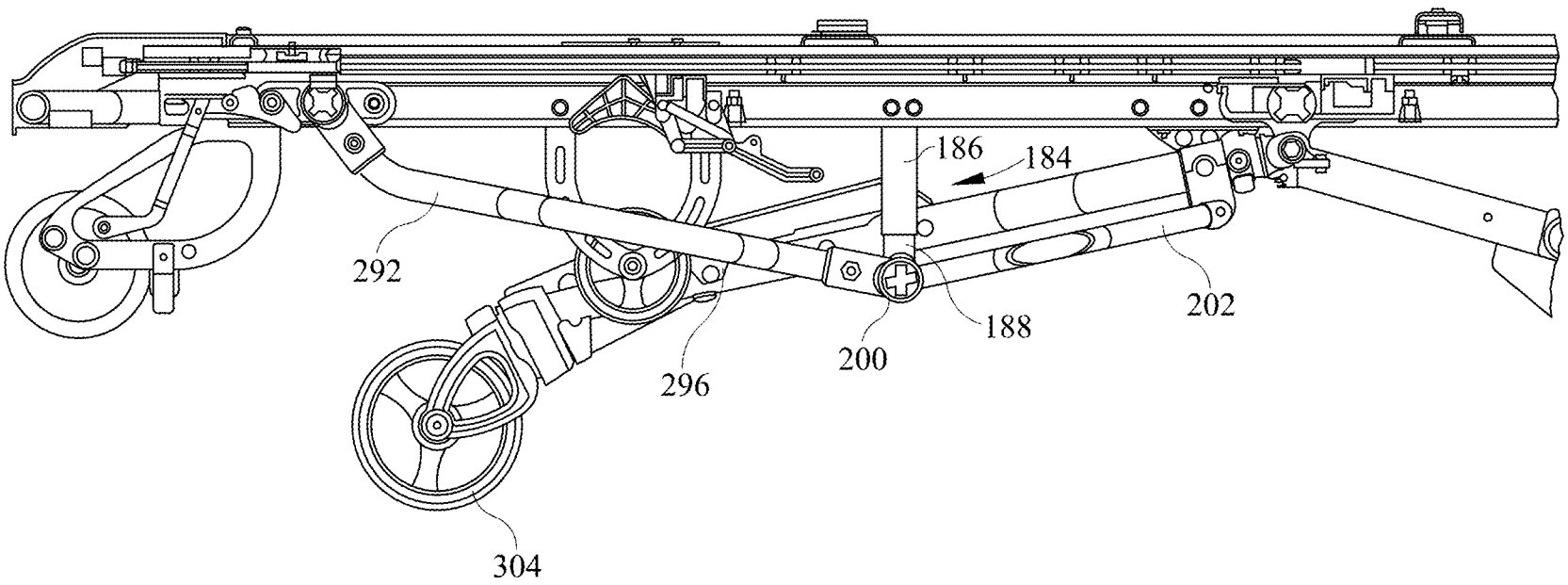
FIGS. 3A and 3B schematically depict a sectional view of a rolling transport cot according to one or more embodiments shown and described herein.
Figure 3B:
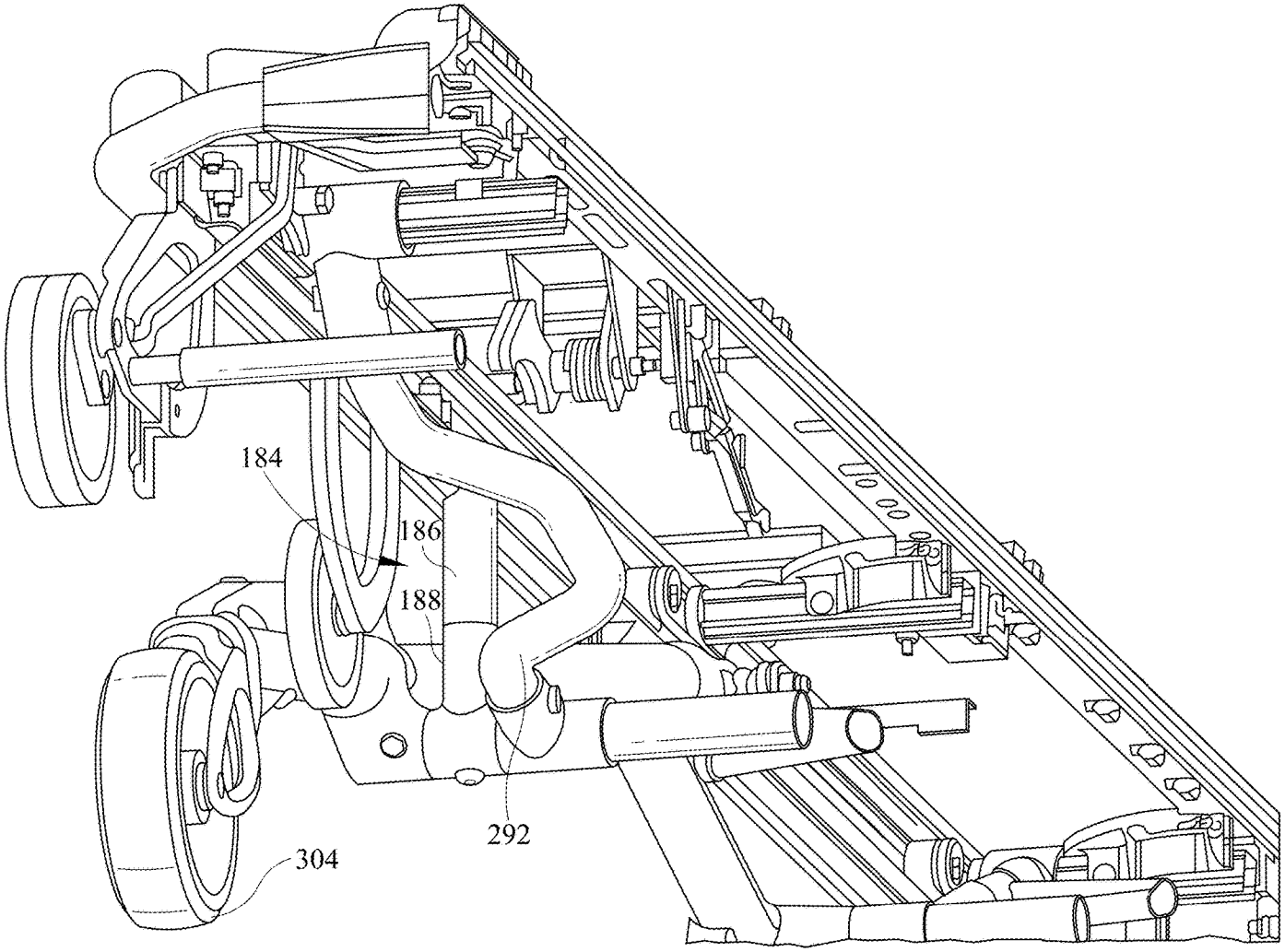

Referring collectively to FIGS. 2C and 3A-3B, embodiments of the rolling transport cot 10 can comprise a modular support member 184 that is configured to provide additional rigidity to the rolling transport cot 10. Specifically, the modular support member 184 can be configured to resist compressive loads that can be applied to during the administration of CPR to a patient that can cause instability in the rolling transport cot 10, i.e., loads that could twist or cause collapse. In some embodiments, the modular support member 184 can be separated when the rolling transport cot 10 is at various extended states, such as, for example, the fully extended state (FIG. 2A) and the mid-level state (FIG. 2B).

The modular support member 184 can comprise a rigid support member 186 and an articulating support member 188 that are configured to engage one another when the rolling transport cot 10 is in the CPR state. For example, the rigid support member 186 and the articulating support member 188 can include complementary features that are configured to engage or interlock. Each of the rigid support member 186 and the articulating support member 188 can be mounted on separate locations of the rolling transport cot 10.

In some embodiments, the rigid support member 186 can be mounted to the elongate frame 100. For example, the rigid support member 186 can be mounted to the elongate frame 100 such that, when the rolling transport cot 10 is in the CPR state, the rigid support member is substantially aligned vertically (i.e., with respect to a substantially level surface). It is noted that, while the rigid support member 186 is depicted as round tubing, the rigid support member can be formed in any shape suitable to withstand the loads applied during CPR and to complement the articulating support member.

The articulating support member 188 can be aligned with the rigid support member 186 such that, when the rolling transport cot 10 is in the CPR state, the articulating support member 188 engages the rigid support member 186 to unite the modular support member 184. Accordingly, when united, the modular support member 184 can be configured to resist compressive loads and provide a substantially stable platform for the administration of CPR. In some embodiments, the articulating support member 188 can be mounted to the cross member 200 of the front support linkage 190. As is noted above, the embodiments described herein can be reversed. Accordingly, the modular support member can be configured for operation with the rear support linkage 120, the front support linkage 190, or both. Moreover, since the articulating support member 188 and the rigid support member 186 are complementary, their mounted locations can be switched without departing from the scope of the present disclosure. It is furthermore noted that, while two of the modular support members 184 are depicted in embodiments of the present disclosure (one on each side), the rolling transport cots 10 described herein can include any number of modular support members 184.

Referring again to FIGS. 2C and 2D, the collapsing motion of the rear support linkage 120 can continue and collapsing motion of the front support linkage 190 can be constrained as the rolling transport cot 10 transitions from the CPR state to the fully collapsed state. Specifically, the frame end 130 of the traveling link 128 can slide further towards the foot end 14 of the elongate frame 100, while the rear linkage angle $\alpha$ is further reduced. Travel of the frame end 197 of the traveling link 196 can be constrained from further collapse by a stop such as, for example, the modular support member 184 or any other keying mechanism. As is explained in further detail below, the rolling transport cot 10 can be provided with a brake mechanism 160 that is automatically actuated when the rolling transport cot 10 is in the fully collapsed state. It is noted that, while the description of the operation of the rolling transport cot 10 has been described in terms of collapse, the rolling transport cot 10 can be raised in a manner that is the reverse of the operation of the collapse described hereinabove.

The automatic actuation of the brake mechanism 160 may be particularly advantageous because, as can be observed in FIGS. 2A-2D, at each state of collapse/extension of the rolling transport cot 10 the wheel 204 and the swivel caster 150 are configured for rolling because the wheel 204 and the swivel caster 150 can be maintained substantially in plane with one another. Thus, when provided with a surface, the rolling transport cot 10 can roll along the surface at any of the described levels of expansion or collapse. Moreover, the swivel caster 150 of the rolling transport cot 10 can be configured to swivel with respect to the rolling transport cot 10.

Figure 4:
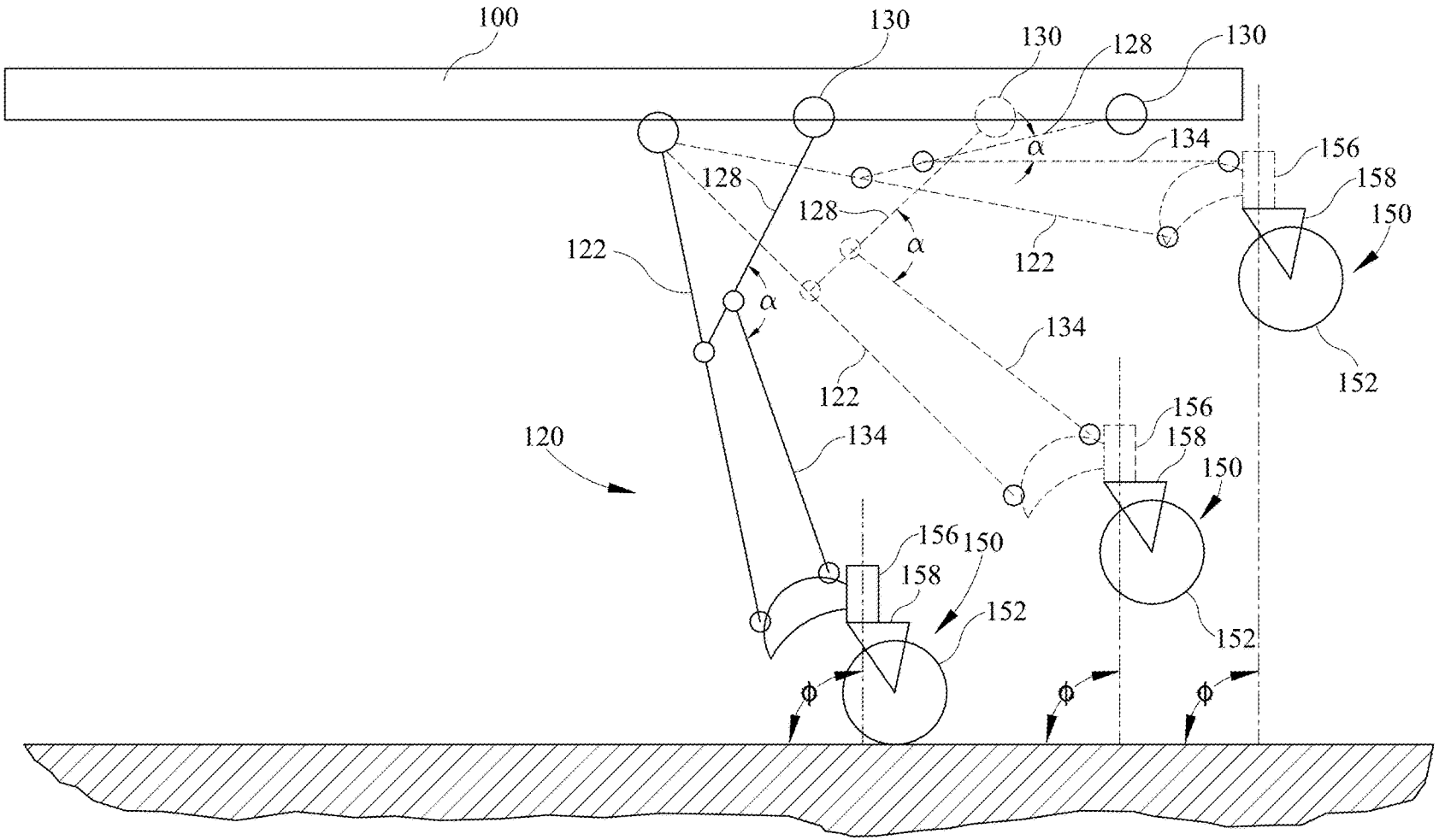
FIG. 4 schematically depicts the articulation of a support linkage of the rolling transport cot according to one or more embodiments shown and described herein.

Referring now to FIG. 4, motion of the rear support linkage 120 is depicted at various states of expansion and contraction. When the wheel 152 of the swivel caster 150 is supported on a substantially level surface, the swivel caster 150 can be aligned with the surface at a swivel angle $\phi$. For example, the swivel caster 150 can comprise a swivel mechanism 156 that rotates around an axis that is aligned with the swivel angle $\phi$. In some embodiments, as the frame end 130 of the traveling link 128 slides along the elongate frame 100 and the rear linkage angle $\alpha$ is altered, the swivel angle $\phi$ can remain substantially constant with respect to the surface. The swivel angle $\phi$ can be considered to be substantially constant with respect to the surface, as long as the swivel mechanism 156 is capable of rotation. In one embodiment, the swivel angle $\phi$ changes less than about 10°. Accordingly, the swivel caster 150 can be configured to swivel throughout the range of motion, i.e., the rear linkage angle $\alpha$ can be provided at any desired angle without losing operation of the swivel caster 150.

Figure 5:
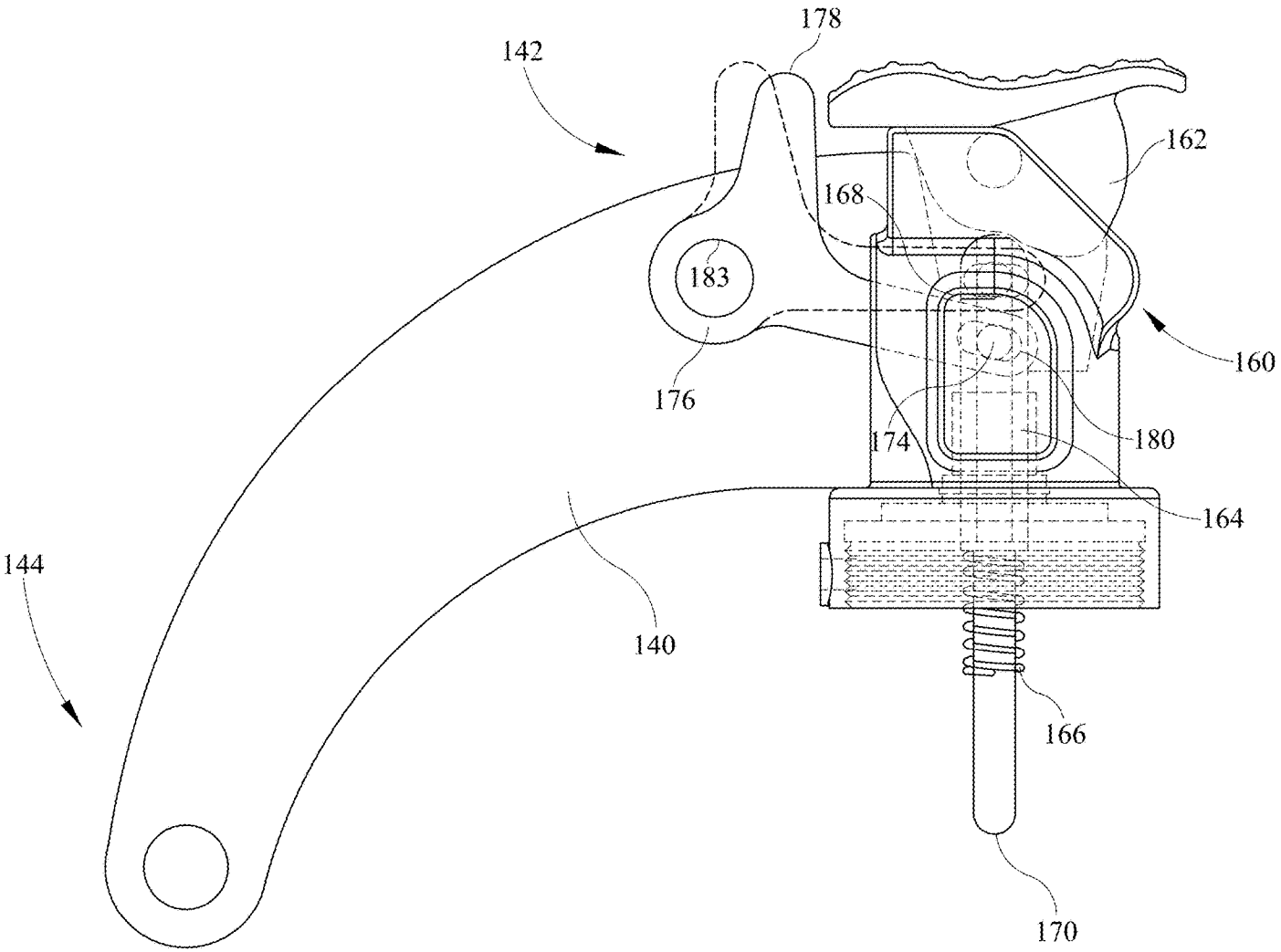
FIG. 5 schematically depicts a brake mechanism according to one or more embodiments shown and described herein.

Referring now to FIG. 5, as is noted above, the rolling transport cot 10 can comprise a brake mechanism 160. The brake mechanism 160 can comprise a rotating cam 162 that cooperates with a piston 164 to apply a stopping force. Specifically, in some embodiments, the brake mechanism 160 can be located on the wheel end 142 of the arcuate coupling member 140. The rotating cam 162 can be configured to rotate with respect to the arcuate coupling member 140. The piston 164 can extend between a following section 168 and a wheel end 170. The piston 164 can cooperate with the rotating cam 162 such that the following section 168 follows the contours of the rotating cam 162 when the rotating cam 162 is rotated with respect to the arcuate coupling member 140.

In some embodiments, the piston 164 can be biased such that a bias force urges the following section 168 of the piston 164 towards the rotating cam 162. In some embodiments, the piston 164 can cooperate with a piston bias member 166. For example, the piston bias member 166 can be a coil spring that is arranged concentrically with the piston 164. The rotating cam 162 can be contoured to stop at an unengaged state and an engaged state. In the unengaged state, rotating cam 162 can be configured to apply a relatively low force or no force tending to actuate the piston 164. In the engaged state, the rotating cam 162 can be configured to apply a relatively high force to actuate the piston 164 and apply a braking force. Accordingly, the rotating cam 162 can be rotated to cause actuation of the piston 164. It is noted that the piston bias member 166 can be any device suitable to apply a bias for urging contact with the rotating cam 162

Alternatively or additionally, the brake mechanism 160 can comprise an angled lever 176 that cooperates with the piston 164 to apply a stopping force. The angled lever 176 can be configured to rotate with respect to the arcuate coupling member 140. For example, the angled lever 176 can comprise a pivoting orifice 183 that can be configured to receive a pin for rotatable engagement with the arcuate coupling member 140. The angled lever 176 can comprise a following member 178 that is configured to provide leverage for the rotation of the angled lever 176 and a guide member 180 that is configured to actuate the piston 164 when the angled lever 176 is rotated. The piston 164 can comprise an engagement member 174 that is configured to interact with the guide member 180 of the angled lever 176, when the piston 164 is actuated. It is noted that, while the guide member 180 and the engagement member 174 are depicted, respectively, as a slot and a pin, the guide member 180 and the engagement member 174 can be any complementary mechanism configured to cause the piston 164 to actuate when the angled lever is rotated such as, for example, complementary surfaces, linkages, and the like.

Figure 6:
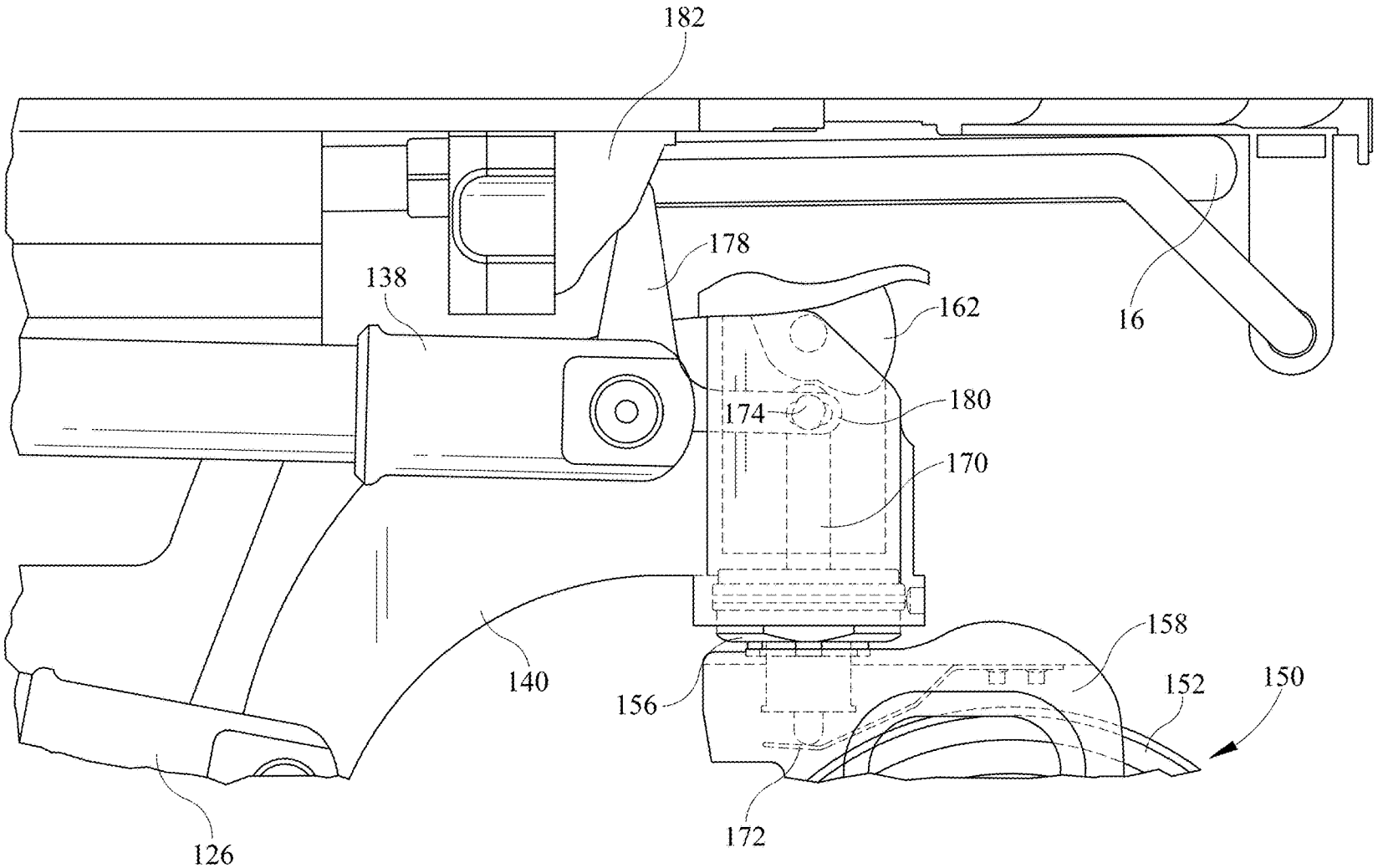
FIG. 6 schematically depicts a brake mechanism according to one or more embodiments shown and described herein.
Figure 7A:
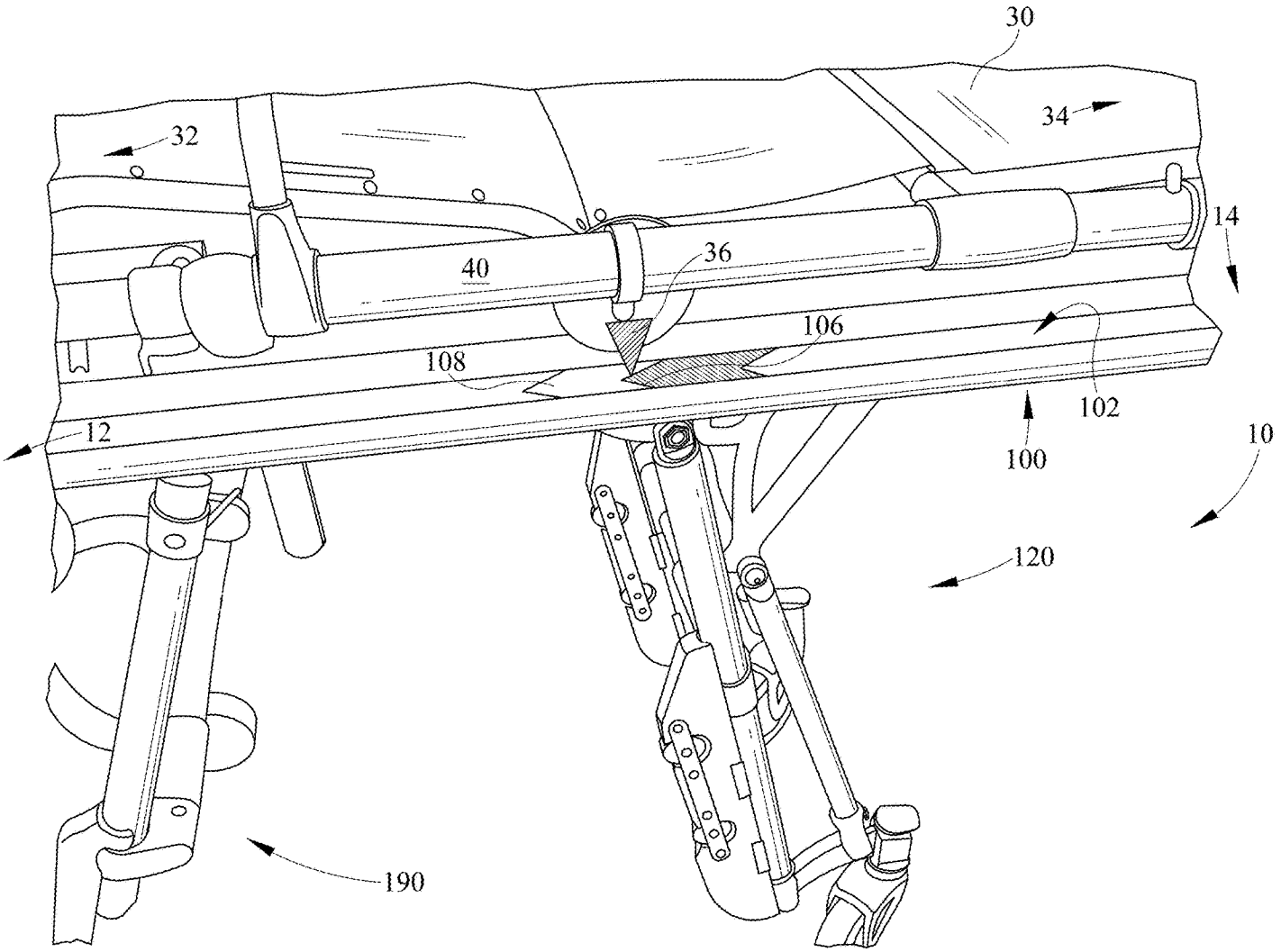
FIGS. 7A and 7B schematically depict a rolling transport cot with a removable stretcher in a reversed state according to one or more embodiments shown and described herein.
Figure 7B:
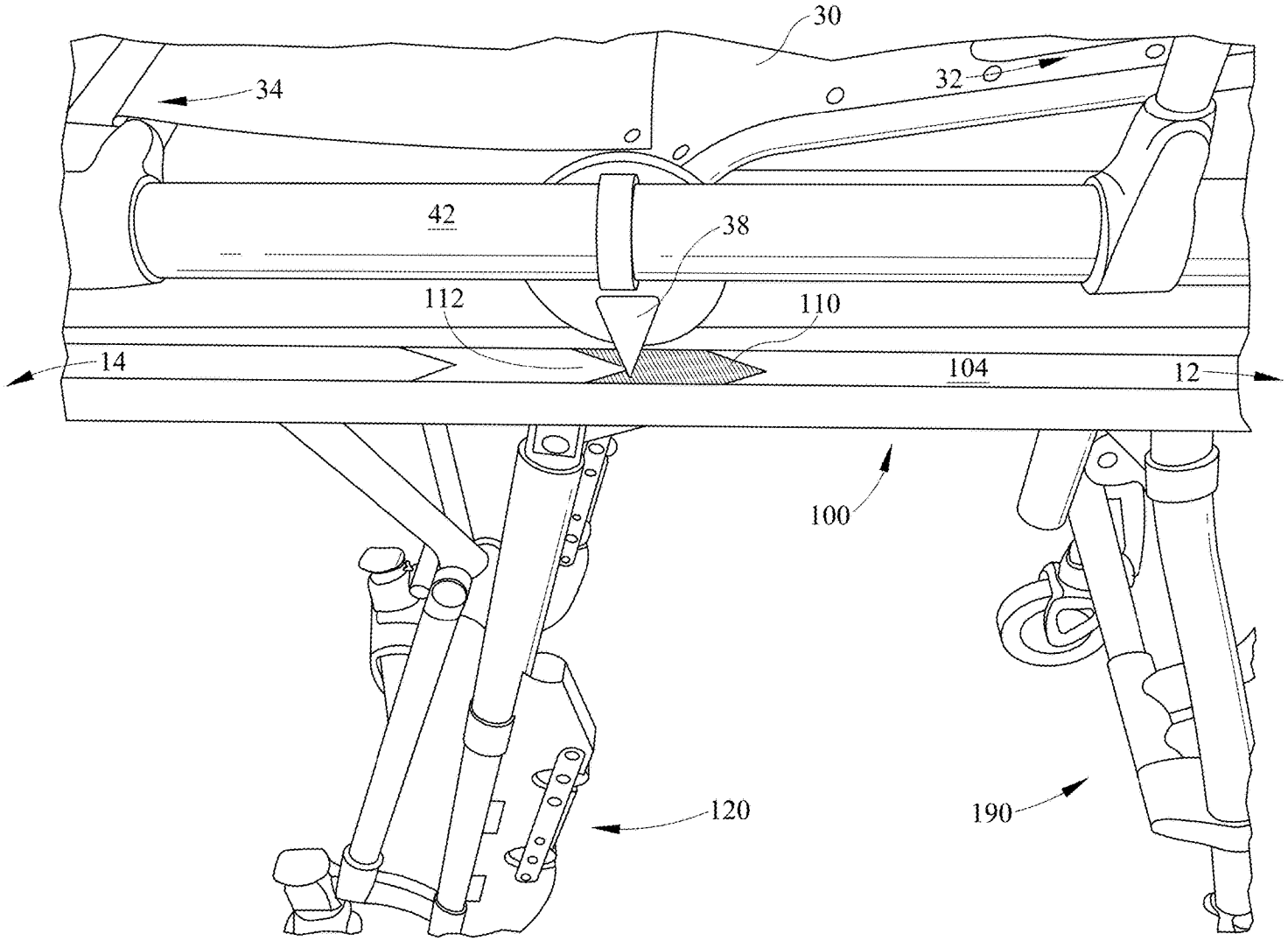

Referring collectively to FIGS. 5 and 6, the brake mechanism 160 can be configured to cooperate with the swivel caster 150 to apply a stopping force to the wheel 152 of the swivel caster 150. Specifically, the piston 164 of the brake mechanism 160 can apply a frictional force to the outer edge of the wheel 152. In some embodiments, the brake mechanism 160 can comprise a friction member 172 that is aligned with the piston 164 such that actuation of the piston 164 by the angled lever 176 or the rotating cam 162 causes the piston 164 to urge the friction member 172 into contact with the wheel 152. The friction member 172 can be any resilient structure suitable to be resistant to fatigue caused by repeated actuation. In some embodiments, the friction member 172 can be formed from material that is flexible and has relatively high yield strength such as, for example, spring steel. In some embodiments, the friction member 172 can be coupled to a fork 158 of the swivel caster 150 and can be configured to be biased against actuation of the piston 164. The friction member 172 can be offset from the piston 164 in the non-actuated state. Alternatively, friction member 172 can be in contact with the piston 164 in the non-actuated state.

According to the embodiments described herein, the brake mechanism 160 can be aligned with the swivel caster 150. For example, the piston 164 can be aligned with a swivel mechanism 156 of the swivel caster 150 such that the motion of the piston 164 during actuation is concentric with the axis of rotation of the swivel mechanism 156. Specifically, a center bore can be formed through the swivel mechanism 156 and the piston can traverse the center bore to actuate the friction member 172. In further embodiments, piston bias member 166 can be concentric with the swivel mechanism 156. In still further embodiments, the swivel mechanism 156 can be aligned along the swivel angle $\phi$ (FIG. 3) with respect to a substantially flat surface.

As is noted above, the brake mechanism 160 can be automatically actuated when the rolling transport cot 10 is lowered (e.g., the fully collapsed state (FIG. 2D)). In some embodiments, the brake mechanism 160 can further comprise a translating cam 182 that is configured to actuate the angled lever 176, when the rolling transport cot 10 is at the desired height. The translating cam 182 can be contoured to complement the shape of the following member 178 such that when the translating cam 182 is brought into contact with the following member 178 the angled lever 176 is rotated and the piston 164 causes a stopping force to be applied to the wheel 152. It is noted that, while the translating cam 182 is depicted as being coupled to the elongate frame 100, the translating cam 182 can be coupled to any portion of the rolling transport cot 10 that sufficiently aligns the translating cam 182 and the angled lever 176. It is furthermore noted, that the angled lever 176 can be aligned with the equalizing link 134 such that their respective rotatable engagement with the arcuate coupling member 140 is concentric. Alternatively or additionally, the angled lever 176 can be aligned with equalizing link 134 such that the following member 178 is at least partially received within a recessed portion of the wheel end 138 of the equalizing link 134, when the rear support linkage 120 is extended.

Referring collectively to FIGS. 7A, 7B, 8A and 8B, the rolling transport cot 10 can be in releasable engagement with a removable stretcher 30. The removable stretcher 30 can include a head end 34 that is configured to support the upper body of a patient and a foot end 32 that is configured to support the lower body of a patient. The removable stretcher can comprise a stretcher head end indication member 36 that is indexed to be indicative of the orientation of the head end 34 of the removable stretcher 30 and a stretcher foot end indication member 38 that is indexed to be indicative of the orientation of the foot end 32 of the removable stretcher 30. In some embodiments, the stretcher head end indication member 36 can be located on a first side 40 of the removable stretcher 30. The stretcher foot end indication member 38 can be located on a second side 42 of the removable stretcher 30.

The rolling transport cot 10 can comprise a head end reversed indicator 106 that is configured to be aligned with the stretcher head end indication member 36, when the head end 34 of the removable stretcher 30 is aligned with the foot end 14 of the rolling transport cot 10. The rolling transport cot 10 can comprise a head end ordered indicator 110 that is configured to be aligned with the stretcher head end indication member 36, when the head end 34 of the removable stretcher 30 is aligned with the head end 12 of the rolling transport cot 10. The rolling transport cot 10 can comprise a foot end ordered indicator 108 that is configured to be aligned with the stretcher foot end indication member 38, when the foot end 32 of the removable stretcher 30 is aligned with the foot end 14 of the rolling transport cot 10. The rolling transport cot 10 can comprise a foot end reversed indicator 112 that is configured to be aligned with the stretcher foot end indication member 38, when the foot end 32 of the removable stretcher 30 is aligned with the head end 12 of the rolling transport cot 10.

Figure 8A:
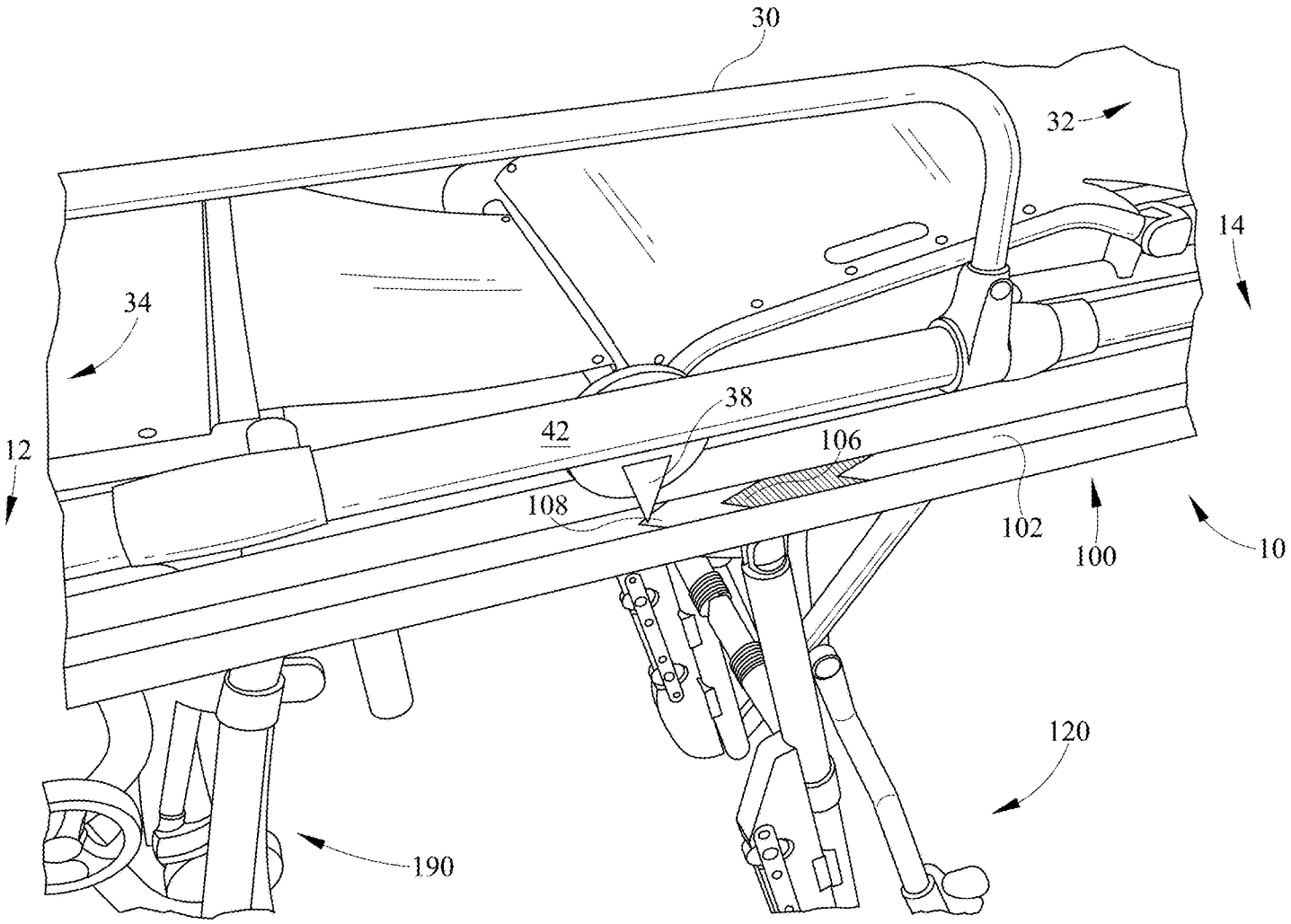
FIGS. 8A and 8B schematically depict a rolling transport cot with a removable stretcher in an ordered state according to one or more embodiments shown and described herein.
Figure 8B:
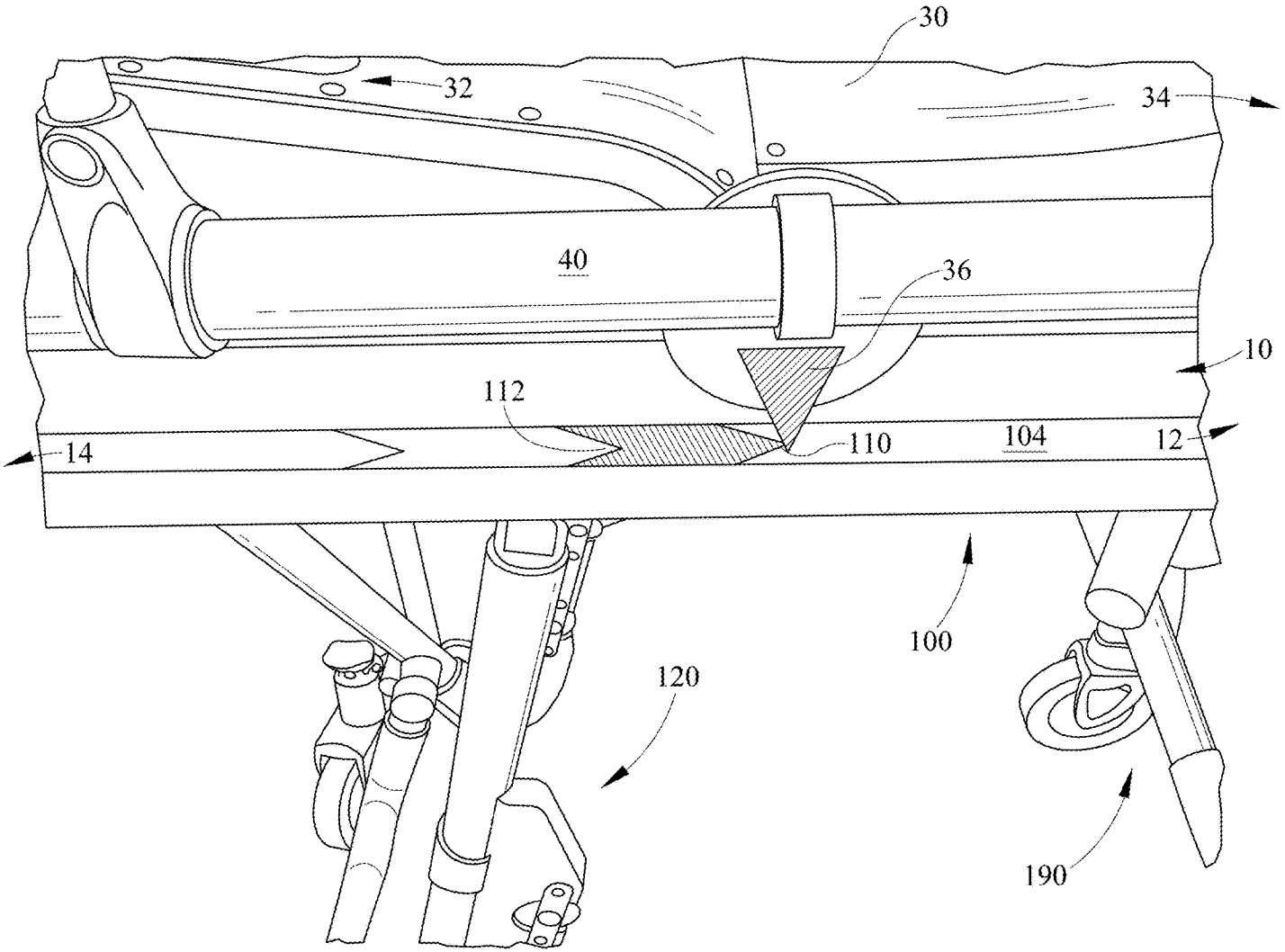

Accordingly, each of the head end reversed indicator 106, the head end ordered indicator 110, the foot end ordered indicator 108, and the foot end reversed indicator 112 can be located at any position on the rolling transport cot 10 sufficient to provide alignment indicating whether the rolling transport cot 10 and the removable stretcher 30 are in the reversed state (FIGS. 7A and 7B) or in the ordered state (FIGS. 8A and 8B). In some embodiments, each of the head end reversed indicator 106, the head end ordered indicator 110, the foot end ordered indicator 108, and the foot end reversed indicator 112 can be located on the elongate frame 100. For example, the head end reversed indicator 106 and the foot end ordered indicator 108 can be located on the first lateral support member 102. The head end ordered indicator 110 and the foot end reversed indicator 112 can be located on the second lateral support member 104.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue. Accordingly, a quantitative representation preceded by the term "about" should be understood to include the exact quantitative representation as well as a functionally equivalent range surrounding the exact quantitative representation.

It is furthermore noted that every explicitly described quantitative range described hereinabove should be understood to include every narrower quantitative range that is bounded by the explicitly described quantitative range, as if each narrower quantitative range was expressly described. For example, an explicitly described range of "45% to 60%"

should be considered to include narrower range between (and inclusive of) the minimum value of 45% and the maximum value of 65%; i.e., all ranges beginning with a minimum value of 45% or more and ending with a maximum value of 65%; or less, e.g., 45% to 50%, 55% to 60%, 48% to 62%, etc While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A rolling transport cot comprising an elongate frame, one or more support linkages, an arcuate coupling member, and a swivel caster, wherein:

the one or more support linkages comprises a pivoting link that is in rotatable engagement with the elongate frame, a traveling link that is in sliding and rotatable engagement with the elongate frame, an equalizing link that is in rotatable engagement with the traveling link;

the arcuate coupling member is in rotatable engagement with the pivoting link and the equalizing link;

the swivel caster comprises a wheel that rotates along a surface and a swivel mechanism in rotatable engagement with the arcuate coupling member; and the swivel mechanism rotates around an axis that is aligned with the surface at a substantially constant swivel angle $\phi$.

2. The rolling transport cot of claim 1, wherein when the traveling link is urged along the elongate frame a vertical distance between the elongate frame and the swivel caster is altered.

3. The rolling transport cot of claim 1, wherein when the traveling link is urged along the elongate frame the arcuate coupling member rotates with respect to the pivoting link and the equalizing link.

4. The rolling transport cot of claim 1, wherein:

the elongate frame extends between a head end and a foot end; and the pivoting link is constrained in a manner that mitigates lateral motion between the head end and the foot end of the elongate frame as the pivoting link rotates with respect to the elongate frame.

5. The rolling transport cot of claim 1, wherein:

the traveling link has a lower end;

the pivoting link has a frame end and a wheel end; and the lower end of the traveling link is in rotating engagement with the pivoting link between 45% to 60% of a span from the frame end and the wheel end of the pivoting link.

6. The rolling transport cot of claim 1, wherein the arcuate coupling member forms gradually sloping upper and lower surfaces between an inner end of the arcuate coupling member and a wheel end of the arcuate coupling member.

7. The rolling transport cot of claim 1, wherein:

each of the pivoting link and the equalizing link has a wheel end; and the arcuate coupling member is in rotatable engagement with the wheel end of each of the pivoting link and the equalizing link.

8. A rolling transport cot comprising an elongate frame, one or more support linkages, and a modular support member, wherein:

a height of the elongate frame is altered by transitioning the one or more support linkages between an extended state and a cardiopulmonary resuscitation (CPR) state;

the one or more support linkages comprises a cross member disposed between two links of the one or more support linkages; and the modular support member comprises a rigid support member coupled to the elongate frame, and an articulating support member coupled to the cross member.

9. The rolling transport cot of claim 8, wherein the rigid support member and the articulating support member are aligned.

10. The rolling transport cot of claim 8, wherein when the one or more support linkages is in the CPR state, the rigid support member and the articulating support member are united.

11. The rolling transport cot of claim 8, wherein when the one or more support linkages is in the CPR state, the rigid support member and the articulating support member are united.

12. The rolling transport cot of claim 8, wherein, when united, the rigid support member and the articulating support member cooperate to resist compressive loads.

13. The rolling transport cot of claim 8, wherein:

the one or more support linkages comprises a pivoting link that is in rotatable engagement with the elongate frame and a traveling link that is in sliding and rotatable engagement with the elongate frame; and a front linkage angle $\beta$ is defined by an intersection of the traveling link and the pivoting link.

14. The rolling transport cot of claim 13, wherein, at the extended state, the front linkage angle $\beta$ is obtuse.

15. The rolling transport cot of claim 13, wherein, at the CPR state, the front linkage angle $\beta$ is acute.

16. A rolling transport cot comprising an elongate frame, one or more support linkages, an arcuate coupling member, a swivel caster, and a brake mechanism, wherein:

a height of the elongate frame is altered by transitioning the one or more support linkages between an extended state and a collapsed state;

the brake mechanism comprises a rotating cam, an angled lever, and a translating cam;

the rotating cam is in rotatable engagement with the arcuate coupling member;

the angled lever is in rotatable engagement with the arcuate coupling member; and the translating cam is coupled to the elongate frame and aligned with the angled lever.

17. The rolling transport cot of claim 16, wherein the arcuate coupling member is in rotatable engagement with the one or more support linkages.

18. The rolling transport cot of claim 16, wherein the swivel caster comprises a wheel that rotates along a surface and a swivel mechanism in rotatable engagement with the arcuate coupling member.

19. The rolling transport cot of claim 18, wherein when the one or more support linkages are in the collapsed state, the translating cam rotates the angled lever to actuate the brake mechanism such that the brake mechanism resists rotation of the wheel.

* * * * *